US008968126B2

(12) United States Patent
Chia

(10) Patent No.: US 8,968,126 B2
(45) Date of Patent: Mar. 3, 2015

(54) FOAM DART HAVING A SAFETY CAP

(71) Applicant: Easebon Services Limited, Kwun Tong (HK)

(72) Inventor: Francis See Chong Chia, Kowloon (HK)

(73) Assignee: Easebon Services Limited, Kwun Tong (HK)

( * ) Notice: Subject to any disclaimer, the term of this patent is extended or adjusted under 35 U.S.C. 154(b) by 31 days.

(21) Appl. No.: 13/964,528

(22) Filed: Aug. 12, 2013

(65) Prior Publication Data

US 2015/0018143 A1 Jan. 15, 2015

Related U.S. Application Data

(60) Provisional application No. 61/844,643, filed on Jul. 10, 2013.

(51) Int. Cl.

| | |
|---|---|
| ***F42B 6/04*** | (2006.01) |
| ***A63B 65/02*** | (2006.01) |
| ***F42B 6/00*** | (2006.01) |
| ***F42B 6/08*** | (2006.01) |

(52) U.S. Cl.
CPC .. *F42B 6/003* (2013.01); *F42B 6/08* (2013.01)
USPC ..... 473/578; 473/582

(58) Field of Classification Search
CPC ..... F42B 6/003; F42B 6/02; F42B 6/04; F42B 6/08
USPC ..... 473/578, 582
See application file for complete search history.

(56) References Cited

U.S. PATENT DOCUMENTS

| | | | | |
|---|---|---|---|---|
| 3,418,995 | A | 12/1968 | Heller | |
| 6,083,127 | A | 7/2000 | O'Shea | |
| 7,861,657 | B2 * | 1/2011 | Danon et al. | 102/502 |
| 8,012,049 | B1 * | 9/2011 | Walterscheid | 473/578 |
| 8,852,038 | B1 * | 10/2014 | Hyde | 473/578 |
| 2006/0014598 | A1 * | 1/2006 | Martin | 473/578 |

OTHER PUBLICATIONS

Micro Dart, http://nerf.wikia.com/wiki/Micro_Dart, (printed Jun. 5, 2014).
Streamline Dart, http://nerf.wikia.com/wiki/Streamline_Dart, (printed Jun. 5, 2014).
Tagger Micro Dart, http://nerf.wikia.com/wiki/Tagger_Micro_Dart, (printed Jun. 5, 2014).
Whistler Dart, http://nerf.wikia.com/wiki/Whistler_Dart, (printed Jun. 5, 2014).

(Continued)

*Primary Examiner* — John Ricci
(74) *Attorney, Agent, or Firm* — Amster, Rothstein & Ebenstein LLP

(57) ABSTRACT

A dart is disclosed that may comprise an elongate dart body, a base, and a cap. The elongate dart body may have a first end, a second end, and an interior cavity, which can be a bore. The base may include a mount and a stem inserted into the interior bore of the dart body at the first end of the dart. The cap may be attached to the base and may have a flexible, substantially bulbous-shaped head portion and an interior post so that the head portion may be configured to deform upon an impact.

20 Claims, 8 Drawing Sheets

(56) References Cited

OTHER PUBLICATIONS

Elite Dart, http://nerf.wikia.com/wiki/Elite_Dart, (printed Jun. 5, 2014).
Micro Dart (Buzz Bee), http://nerf.wikia.com/wiki/Micro_Dart_(Buzz_Bee), (printed Jun. 5, 2014).
Mongo Clip Dart, http://nerf.wikia.com/wiki/Mongo_Clip_Dart, (printed Jun. 5, 2014).
Air Zone—Foam Blaster product photograph.
Air Zone—"Vigilante", http://nerf.wikia.com/wiki/Vigilante.
Air —"Vigilante" (twin barrel), http://nerf.wikia.com/wiki/Vigilante.

* cited by examiner

FOAM DART HAVING A SAFETY CAP

CROSS-REFERENCE TO RELATED APPLICATION

The present application claims priority to U.S. Provisional Patent Application No. 61/844,643, filed on Jul. 10, 2013, the entire contents of which are incorporated by reference herein.

FIELD

The present invention generally relates to a foam dart having a safety cap.

SUMMARY

The present invention generally relates to a foam dart having a safety cap. In exemplary embodiments, the foam dart comprises a body portion comprised of foam, a safety cap including a deformable head portion with an interior post, and a mounting base in which the deformable head portion is mounted and which, in turn, is mounted to the body portion.

In embodiments, a dart is disclosed that may comprise an elongate dart body, a base, and a cap. The elongate dart body may have a first end, a second end, and an interior cavity, which can be a bore. The base may include a mount and a stem inserted into the interior bore of the dart body at the first end of the dart. The cap may be attached to the base and may have a flexible, substantially bulbous-shaped head portion and an interior post so that, the head portion may be configured to deform upon an impact.

In embodiments, the dart body can be comprised of foam. In embodiments, the dart body can have different cross-sectional shapes, such as, e.g., circular, square, rectangular, and star-shaped, to name a few.

In embodiments, a chamber may be disposed between the head portion and the base. The head portion can be configured to at least partially collapse into the chamber upon an impact.

In embodiments, the cap may be configured such that the post may forcibly contact a portion of the base upon an impact. In embodiments, the base may be configured to absorb energy from the post upon an impact. In embodiments, the post may be configured such that the post forcibly contacts a portion of the dart body upon an impact. In embodiments, the dart body may be configured to absorb energy from the post upon an impact.

In embodiments, the interior bore of the body in combination with the chamber in the safety cap and base may form an interior fluid path. In embodiments, the cap may be configured such that the cap is deformed and fluid is forced through the fluid path to exit the interior bore of the body upon an impact. In embodiments, the interior fluid path may further comprise an aperture formed on an outer surface of the dart ahead of the second end of the dart body, so that the aperture can generate an audible sound as fluids are moved therealong when the dart is in flight.

In embodiments, the cap may be configured such that the cap comprises a resilient material, so that upon impact, the cap may be deformed but be capable of returning to its pre-impact shape. In embodiments, the head portion of the cap may be affixed to the base along a groove disposed along an upper surface of the base.

In embodiments, the cap may have a length of between about 8 mm and about 27 mm, the cap may have a diameter of less than about 11 mm at its widest point, the base may have a length of about 8 mm to about 12 mm, and the base may have a diameter at its widest point between about 9 mm and about 13 mm. In embodiments, the cap may have attached to it a suction member. In embodiments, the head portion of the cap may have a Shore A durometer of about 55. In embodiments, the head portion of the cap may be about 0.5 mm thick.

In embodiments, a foam dart safety cap may include a head portion and a post extending away from the head portion. In embodiments, the dart may have a center of gravity near the first end of the dart body, wherein the first end of the dart body can be a head end of the dart body, and the base is affixed at the head end. In embodiments, the interior bore of the body in combination with the chamber in the safety cap and base can form an interior fluid path with an opening at a second end of the body, which is a tail end, and upon impact with a target, fluids may be evacuated from the tail end of the dart.

BRIEF DESCRIPTION OF THE DRAWINGS

Various exemplary embodiments of this invention will be described in detail, with reference to the following figures, wherein.

DETAILED DESCRIPTION

Figure 1:
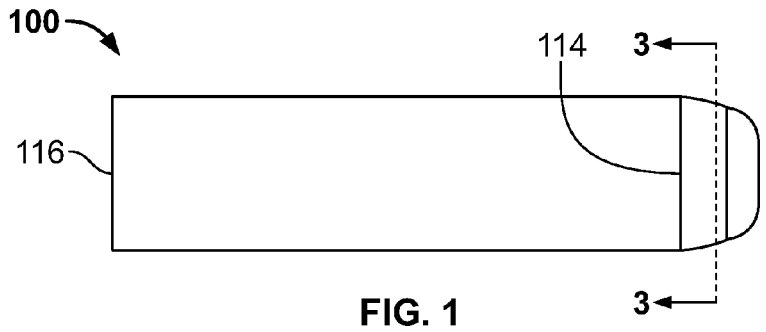
FIG. 1 is a side view of a dart including a safety cap according to an exemplary embodiment of the present disclosure.
Figure 2:
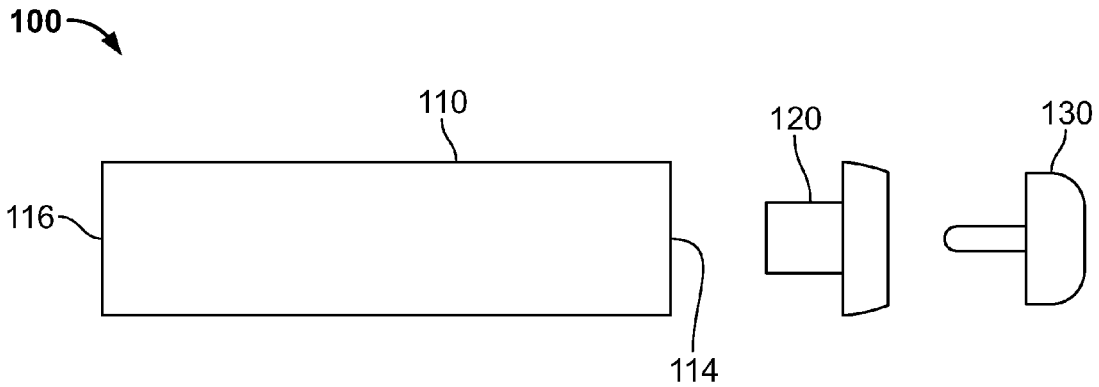
FIG. 2 is a parts-separated view of the dart in FIG. 1.
Figure 3:
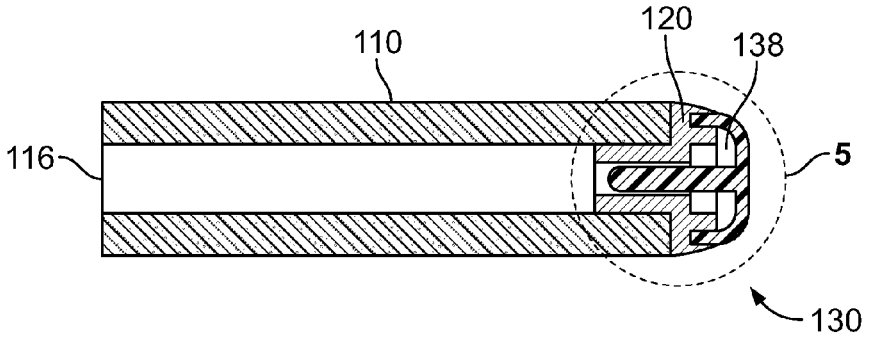
FIG. 3 is a cross-sectional view of the dart in FIG. 1.
Figure 1A:
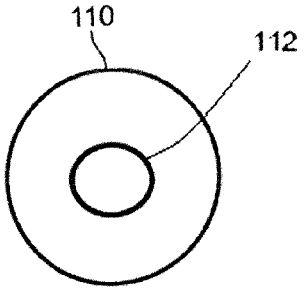
FIG. 1A is a cross sectional view of the body of the dart of FIG. 1.

The present invention is generally directed towards a foam dart, e.g., a foam dart for use in a toy dart launcher. In embodiments, the present invention is directed towards a foam dart having a safety cap. In exemplary embodiments, the safety cap may reduce the force of impact of the dart against a target, e.g., a human person. In embodiments, the safety cap may have a sufficient mass such that a center of gravity of the dart is positioned toward a head end of the dart.

Referring to FIGS. 1, 1A, 2, 3, 4, 4A, and 5, a dart according to an exemplary embodiment of the present disclosure is generally described as 100. Dart 100 may be configured for launch from, e.g., a toy dart launcher (not shown). Dart 100 may have an elongate profile configured for aerodynamic travel, e.g., flight, toward a target, e.g., a human person or other object. In embodiments, dart 100 may have a length of about, e.g., between and including about 55 mm and about 75 mm, such as 59 mm, 65 mm, 67 mm, 70 mm, 73 mm, or 74 mm, to name a few. In embodiments, dart 100 may have a cross-sectional diameter at its widest point of, e.g., 12.5 mm, 13 mm, 14 mm, or 15 mm, to name a few. In embodiments, dart 100 may have other lengths, widths, and diameters.

Dart 100 may include a body 110, a base 120 coupled with body 110, and a cap 130. Base 120 may be at least partially inserted into a body bore 112 near head end 114 of the body 110. Cap 130 may be affixed to the base 120 such that cap 130 is disposed on or near head end 114 of the body 110. Cap 130 may be configured to provide a safety feature directed to controlling aspects of the impact of the dart 100 with a target, as will be described further below. It will be understood that the body 110, base 120, and cap 130 of dart 100 may be comprised of any suitable materials for their intended purposes, and that the body 110, base 120, and cap 130 may be comprised of similar or different materials from each other. It will be understood that the various components of dart 100 may have any suitable dimensions for their intended purposes.

Body 110 may be comprised of a lightweight material, e.g., foam, suitable for use in a toy projectile, and may have an elongate profile with a circular cross-section, e.g., a cylindrical member. Body 110 may include a first end 114, e.g., head end, and a second end 116, e.g., tail end. Body 110 may have an elongate profile that is tubular, e.g., cylindrical, rectangular or pyramidal, to name a few.

Figure 1B:
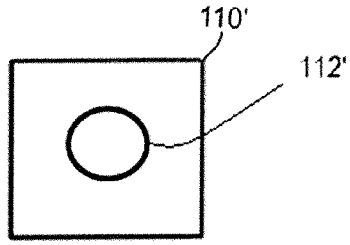
FIG. 1B is a cross sectional view of a body of a dart according to an embodiment of the present disclosure.
Figure 1C:
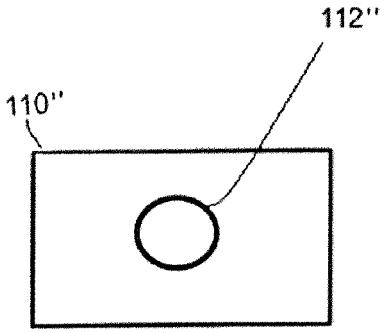
FIG. 1C is a cross sectional view of a body of a dart according to an embodiment of the present disclosure.
Figure 1D:
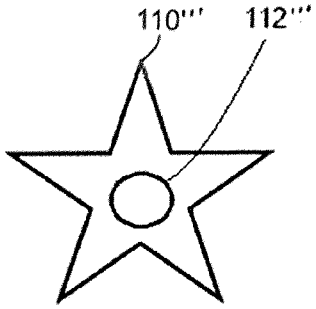
FIG. 1D is a cross sectional view of a body of a dart according to an embodiment of the present disclosure.
Figure 4:
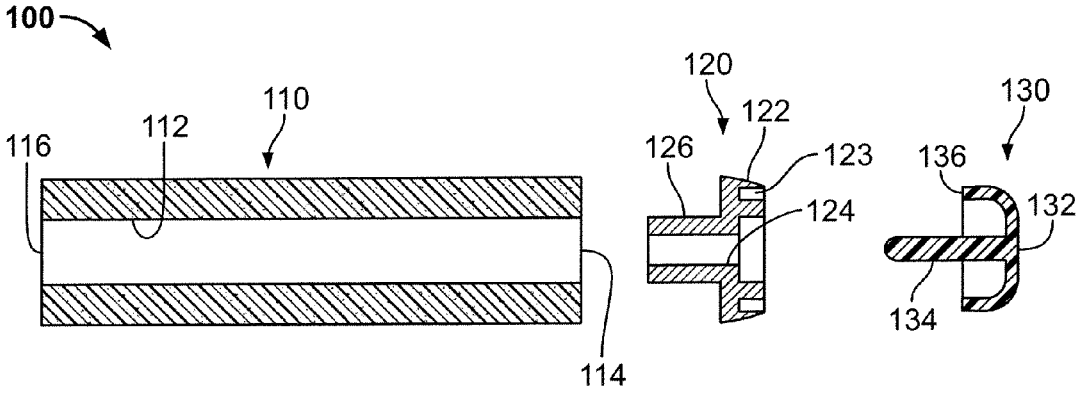
FIG. 4 is a cross-sectional, parts-separated view of the dart in FIG. 1.
Figure 4A:
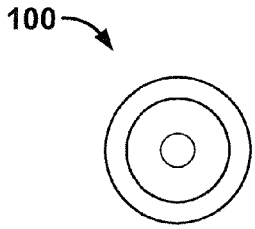
FIG. 4A is a cross-sectional view taken along section line 4A-4A of FIG. 1.
Figure 5:
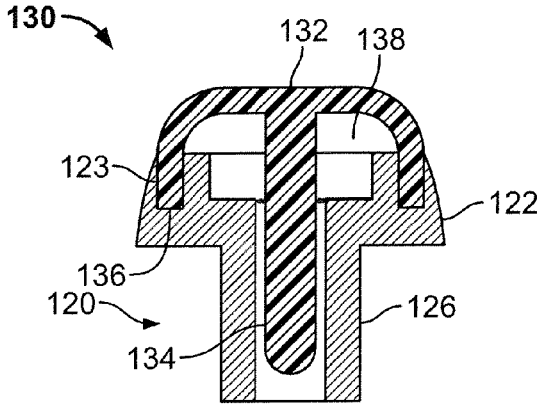
FIG. 5 is an enlarged view of the area of detail identified in FIG. 3.

Turning to FIGS. 1B, 1C, and 1D, in exemplary embodiments, a dart body 110', 110", 110" may have different shapes and/or cross-sectional configurations, e.g., square, rectangular, or star-shaped, as shown, respectively. In embodiments, a dart body may be, e.g., ovoid, pyramidal, diamond-shaped, heptagonal, or octagonal in cross-section, to name a few. Dart bodies 110'. 110", 110'" may include respective body bores 112', 112", 112'". Body bores 112', 112", 112'" may have a circular cross-sectional configuration, as shown. In embodiments, body bores 112', 112", 112" may have differently-shaped cross-sectional configurations, e.g., ovoid, rectangular, or pyramidal, to name a few.

Referring back to FIGS. 1, 1A, 2, 3, 4, 4A, and 5, the lightweight configuration of body 110 allows the dart 100 to have an arrangement such that the more massive components of dart 100, e.g., base 120 and cap 130, may be disposed toward the head end 114 of the dart 100 such that center of gravity may be shifted toward the head end 114 of the dart 100, e.g., to aid in flight distance. The body 110 may have an interior cavity, such as body bore 112, which extends partially or entirely therethrough. In embodiments, body 110 may include an interior core for providing the body 110 with certain mechanical properties, e.g., rigidity or resiliency. In embodiments, the body 110 may be formed of one or more pieces.

In embodiments, base 120 may comprise a mount 122 and a stem 126 extending therefrom. Mount 122 may abut the head end of the body 110, e.g., to support cap 130. Stem 126 may be inserted into the body bore 112. In embodiments, the stem 126 and the body bore 112 may have similar and/or corresponding cross-sectional shapes. In embodiments, the outer diameter of stem 126 may have the same or a different, e.g., smaller, diameter than the diameter of body bore 112. In embodiments, stem 126 may be inserted into the body bore 112 of the body 110 of dart 100 to couple the base 120 with body 110, such as by press fitting the stem 126 into the bore 112 or adhering the stem 126 into the bore 112.

In exemplary embodiments, mount 122 can be a substantially planar member that comprises an opening extending to a mount bore 124 extending through the stem 126 and can be in fluid communication with the body bore 112 of body 110. In the exemplary embodiment shown, mount bore 124 may have a different diameter than the body bore 112 of body 110, e.g. smaller diameter. In such embodiments, the mount bore 124 of base 120 may present a restricted passage, e.g., narrowed, such that fluids (e.g., air) flowing between the body bore 112 and the chamber 138 encounter a flow resistance in the mount bore 124. Mount 122 may also have an upper surface including a groove 123 to receive a portion of the cap 130, as described further herein. In exemplary embodiments, base 120 may have a diameter at its widest point of about, e.g., 13 mm, groove 123 may have an outer diameter of about, e.g., 11 mm, and an inner diameter of about, e.g., 9.8 mm, stem 126 may have a diameter of about, e.g., 6 mm, and mount bore 124 may have a diameter of about, e.g., 3.5 mm. In embodiments, the diameter of base 120 at its widest point may be about, e.g., between and including 9 mm and 13 mm, such as 10 mm, 11 mm, 12 mm, or 13 mm, to name a few. In embodiments, the diameter of base 120 at its widest point may not exceed, e.g., the outer diameter of dart body 110. In embodiments, the various components of base 120 may have different dimensions. Base 120 may have a region of increased mass relative to the other portions of dart 100. In such embodiments, base 120 may facilitate positioning a center of gravity and/or mass of the dart 100 toward the head end 114 of the dart 100, e.g., to aid in achieving a desired flight distance. In embodiments, a dart body 110 having a length of about, e.g., between and including about 57 mm and about 65 mm, may be coupled with a mount having a length of about, e.g., between and including about 10 mm and about 27 mm, such as a 65 mm dart body and a 10 mm mount, a 65 mm dart body and a 27 mm mount, a 63 mm dart body and a 13 mm mount, or a 57 mm dart body and an 11 mm mount, to name a few.

In embodiments, cap 130 includes a head portion 132 and a post 134 extending from an interior surface of the head portion 132. The post 134 of cap 130 may extend into the mount bore 124 of the base 120 such that a coextensive region of the body 110, base 120, and cap 130 may extend along a head end 114 of the dart 100. The post 134 of cap 130 may be inserted into the mount bore 124 of base 120. Further, the head portion 132 of cap 130 may be affixed e.g., adhered, within the groove 123 of mount 122 of base 120 to couple the body 110, base 120, and cap 130.

Cap 130 may be comprised of a flexible and/or resilient material, e.g., a thermoplastic elastomer (TPE), e.g., thermoplastic rubber (TPR), polyvinyl chloride (PVC), styrene-butadiene-styrene (SBS), or ethylene-vinyl acetate (EVA), having a Shore A durometer of, e.g., 55. In embodiments, cap 130 may have different Shore durometer measurements. In embodiments, cap 130 may be measured along another Shore durometer scale, e.g., Shore A, Shore D, or Shore OO, to name a few. In exemplary embodiments, cap 130 may have a length of about, e.g., between and including about 8 mm and about 27 mm, such as 8 mm, 10 mm, 12 mm, 13 mm, 14 mm, 16 mm, 17 mm, 18 mm, 21 mm, or 23 mm, to name a few. The head portion 132 of cap 130 may be a membrane-like material and may have a bulbous, e.g., having a surface that is generally swept back toward the dart body 110 in side profile. A proximal rim 136 of the head portion 132 may be affixed, e.g., adhered, within the groove 123 of base 120. With additional reference to FIG. 4A, head portion 132 may have a configuration that tends to distribute forces applied to a point of contact of the head portion 132 across the surface of head portion 132. Head portion 132 may be a continuous, substantially-fluid tight member such that a chamber 138 is disposed between the interior surface of head portion 132 of cap 130 and the mount 122 of base 120. In embodiments, chamber 138 may be partially enclosed. In embodiments, chamber 138 may be fully enclosed. The head portion 132 of cap 130 may be formed of a thin, e.g., about 0.5 mm thick, layer of material. In embodiments, the head portion 132 of cap 130 may have a different thickness. In embodiments where the head portion 132 of cap 130 is formed of a relatively thin material, head portion 132 may be sufficiently flexible, e.g., pliable or deformable, under applied loads to deform without requiring a material with an excessively low Shore durometer measurement. In embodiments, head portion 132 of cap may be formed of a relatively soft, e.g., having at least a moderate damping coefficient, material, e.g., to avoid discomfort or injury upon impact with, e.g., a human person. In embodiments, the post 134 may have a different, e.g., larger, thickness, such that the head portion 132 and post 134 of cap 130 may perform differently under applied loads, e.g., head portion 132 may deform more easily than post 134, e.g., head portion 132 may deform before post 134 under similar or identical applied loads. In embodiments, post 134 may be dimensioned such that cap 130 has a sufficient mass to shift a center of gravity of dart 100 towards a head end of dart 100. In exemplary embodiments, post 134 may have a diameter of, e.g., about 3 mm. In embodiments, post 134 may have a different diameter. In embodiments, cap 130 may have a different configuration, e.g., a curvate profile suitable to create suction with a target surface. In embodiments, cap 130 may include a suction-generating member, e.g., a suction cup, disposed on an outer surface of cap 130. In embodiments, cap 130 may include a region of increased friction, e.g., to provide an enhanced grip with a target surface.

In embodiments, cap 130 may have a differently shaped side profile. Turning to FIGS. 8A, 8B, 8C, 8D, and 8E, dart 100 with cap 130 is shown in side view with darts 200, 200', 200", 200'" according to exemplary embodiments of the present disclosure. Dart 200 may have a cap 230 which has a flat-fronted profile that may be, e.g., rounded rectangular in side view. Dart 200' may have a cap 230' which has a flat-fronted profile that may be, e.g., snub-nosed or trapezoidal in side view. Dart 200" may have a cap 230" which has a pointed profile that may be, e.g., triangular or diamond-shaped in side view. Dart 200'" may have a cap 230'" which has a rounded profile that may be, e.g., hemispherical or semi-circular in side view, to name a few. In embodiments, darts may have a cap with a side profile that is, e.g., tapered, pointed, dome-shaped, ovoid, rectangular, heptagonal, and/or octagonal, to name a few. In embodiments, a dart may have a cap that may have a forward surface that is, e.g., pointed, flat, or round, to name a few.

Figure 6A:
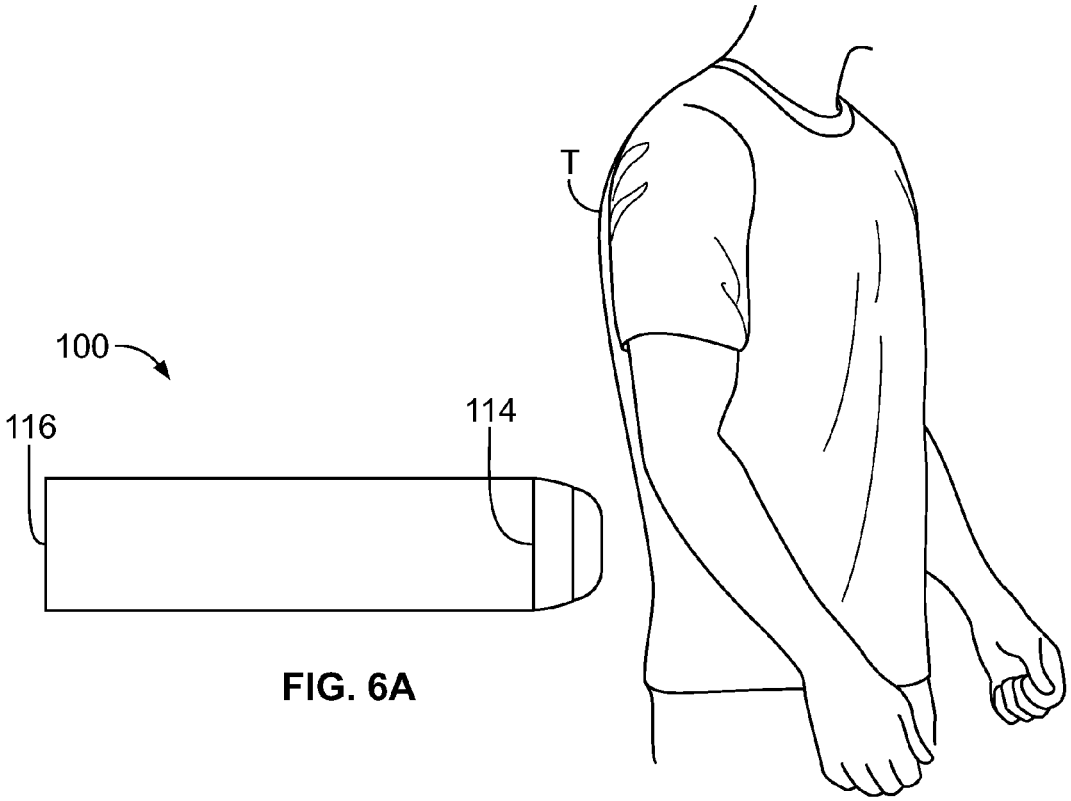
FIG. 6A is a side view of the dart of FIG. 1 approaching a target.
Figure 6B:
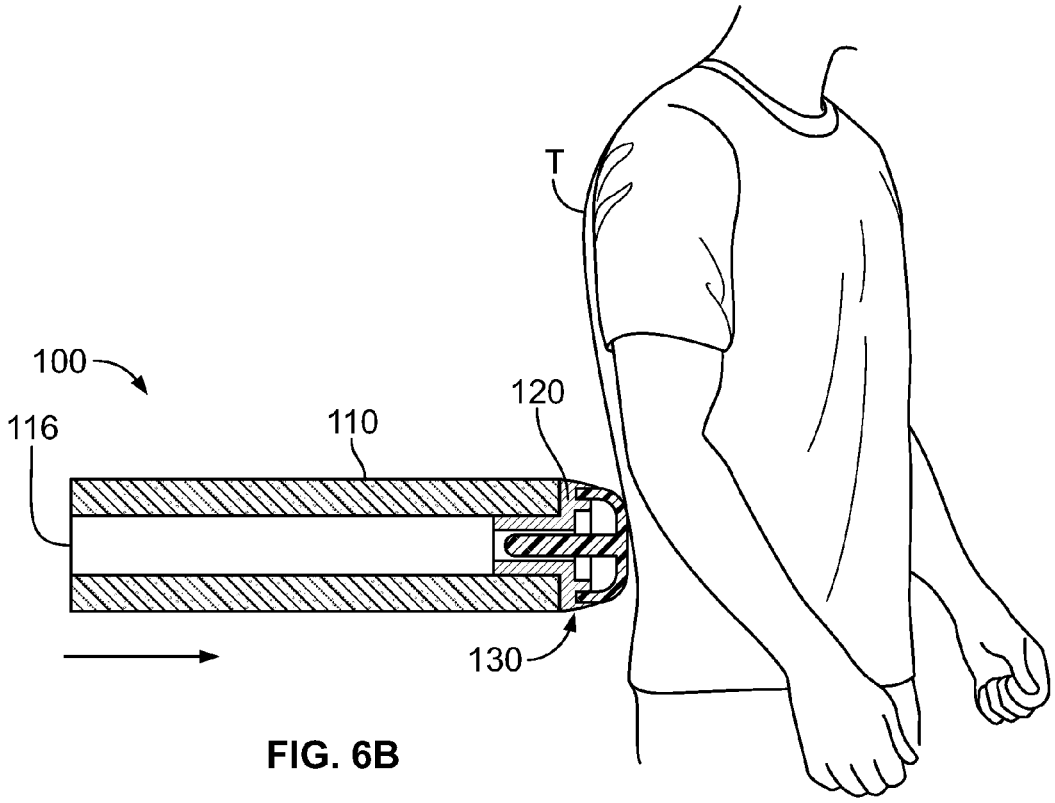
FIG. 6B is a side, cross-sectional view of the dart of FIG. 1 contacting the target.
Figure 6C:
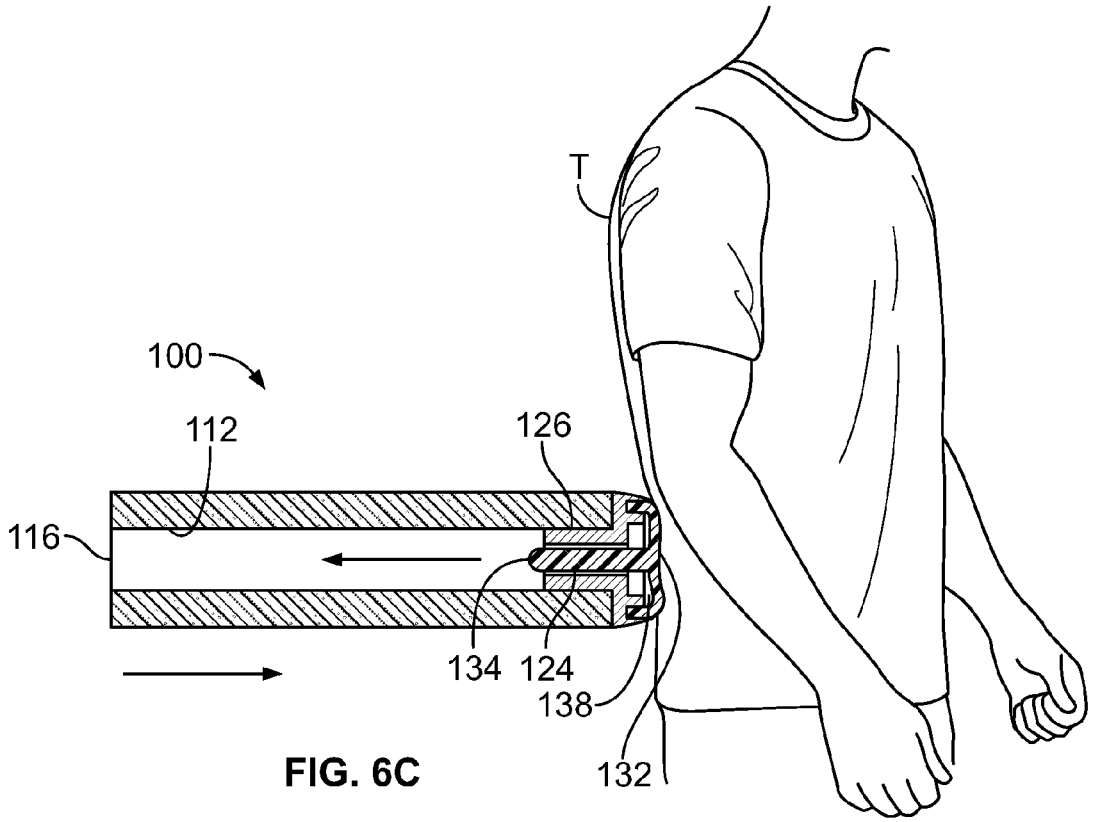
FIG. 6C is a side, cross-sectional view of the dart of FIG. 1 deforming upon impact with the target.

Turning to FIGS. 6A, 6B, and 6C in an exemplary embodiment, dart 100 may be launched from a dart launcher, e.g., via air or other fluids forced distally through the body bore 112 of body 110 of dart 100. As the fluids reach the portion of the body bore 112 including the post 134 of the cap 130, the forced fluids create a pressure differential behind the head portion 132, e.g., a region of higher pressure is generated behind the cap 130 within body bore 112, stem 126, and chamber 138, and a region of relatively lower pressure, e.g., ambient air pressure, may be disposed in front of the head portion 132. Such a pressure differential causes the dart 100 to launch, e.g., propel, from the dart launcher toward a target T, e.g., a human person. In embodiments, dart 100 may be launched toward an object or marking intentionally placed as a target, e.g., a freestanding, suspended, and/or painted bulls-eye or marking. In embodiments, dart 100 may be launched toward a target that is devoid of markings or other identifying characteristics. In embodiments, dart 100 may be launched toward an object other than a target, e.g., an unintended target or object obstructing a target. In embodiments, dart 100 may be configured such that pressurized fluids do not travel through the body bore 112 toward the head end 114 of the dart 100, but rather build up behind, e.g., an enclosed or valved distal end, to launch the dart 100 from a dart launcher. It will be understood that dart 100 may be launched from any type of launcher, e.g., a spring-loaded or other tension-loaded device.

As the dart 100 approaches target T, the head portion 132 of dart 100 may make first contact with an outer surface of the target T. Because the dart 100 may be forcibly launched as described above, dart 100 may forcibly impact the target T. Accordingly, the target T may exert a force, e.g., a normal force N, against the dart 100 at the point of contact between the dart 100 and the target T. The configuration of the head portion 132 of dart 100 may be such that the head portion 132 deforms, e.g., deflects, warps, bends, or crushes, in response to the normal force N. Such a deformation may cause the head portion 132 to at least partially collapse into the chamber 138 disposed in the head portion 132. As described above, the post 134 of cap 130 may not entirely obstruct the mount bore 124 of the base 120 of the body 110 of dart 100 such that fluids, e.g., air, disposed within the chamber 138 defined by head portion 132 during impact of dart 100 against the target T, may be expelled through the mount bore 124 of base 120 and into the body bore 112 of body 110 and exit out the tail end 116 of dart 100, facilitating the deformation of head portion 132 into the chamber 138 as it is evacuated of fluids. In this manner, the chamber 138 in combination with the body bore 112 may form an interior fluid path extending away from the cap 130 toward a tail end 116 of the dart 100. As the cap 130 is deformed, fluids may be forced through the interior fluid path to exit the body bore 112. In embodiments, dart 100 may include an aperture on an outer surface thereof at some point ahead of the tail end 116 of dart body 110 for fluid to pass. In such embodiments, the aperture can generate an audible sound, e.g., a whistle, as fluids are passed therealong when the dart is in flight.

Deformation of the head portion 132 into the chamber 138 may cause the post 134 to be urged in the direction of the tail end 116 of dart 100 within the mount bore 124 of the base 120. In this manner, at least a portion of the normal force N generated upon impact of the dart 100 with the target T may be transformed into motion of the head portion 132 and post 134 of cap 130. In this manner, the impact force of dart 100 against target T can be reduced, e.g., to reduce discomfort experienced by the target T. Further, the post 134 may serve to reinforce, e.g., bolster, the head portion 132 such that the head portion 132 may return to its pre-collapsed condition following an impact, e.g., cap 130 may have a resilient configuration. In embodiments, a dart 100 that has already been launched and impacted against target T may be re-loaded into a dart launcher. In such embodiments, a cap 130 having a collapsed configuration may be returned to its substantially pre-collapsed condition, e.g., by fluids forced through the body bore 112 and mount bore 124 into the chamber 138 to generate pressure behind head portion 132 and cause head portion 132 to expand to substantially its pre-collapse configuration.

Figure 7A:
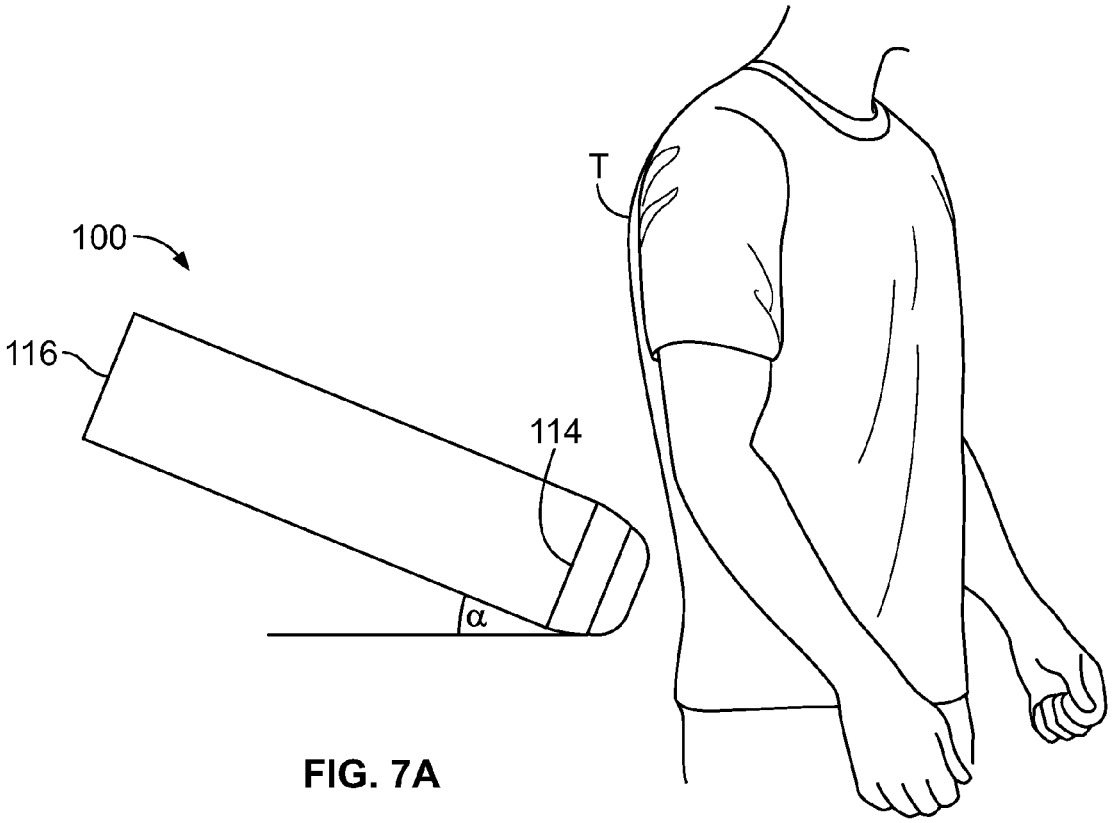
FIG. 7A is a side view of the dart of FIG. 1 approaching a target at an oblique angle.
Figure 7B:
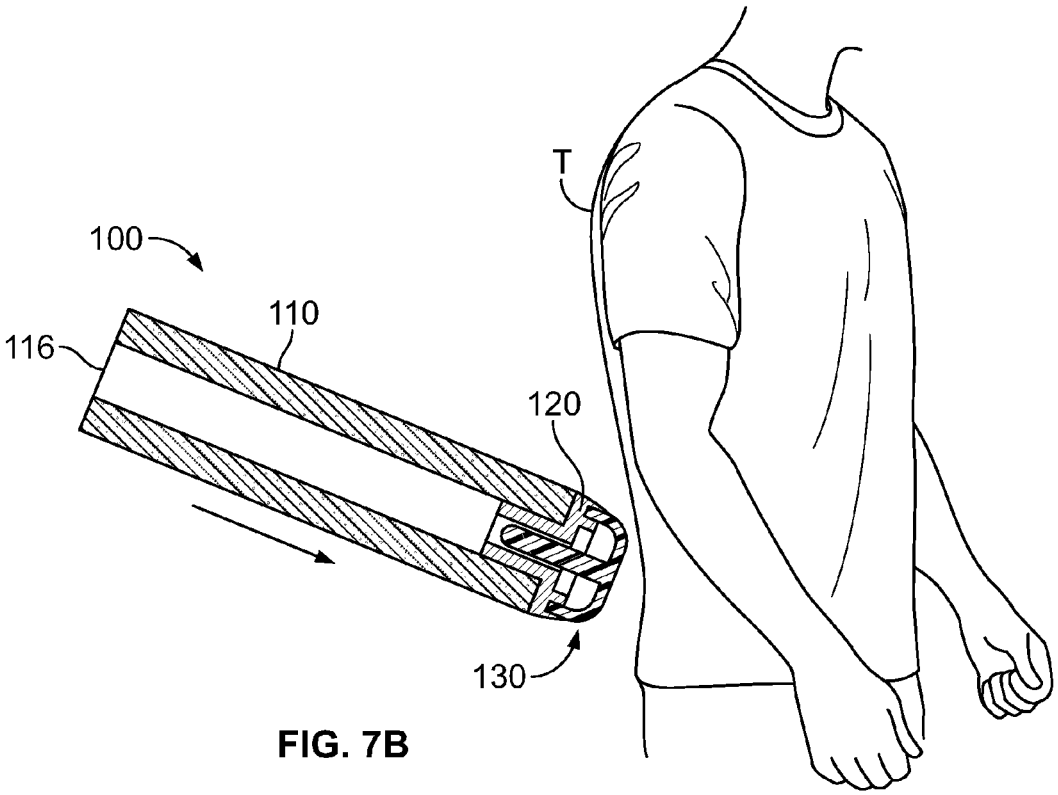
FIG. 7B is a side, cross-sectional view of the dart of FIG. 1 contacting the target at an oblique angle.
Figure 7C:
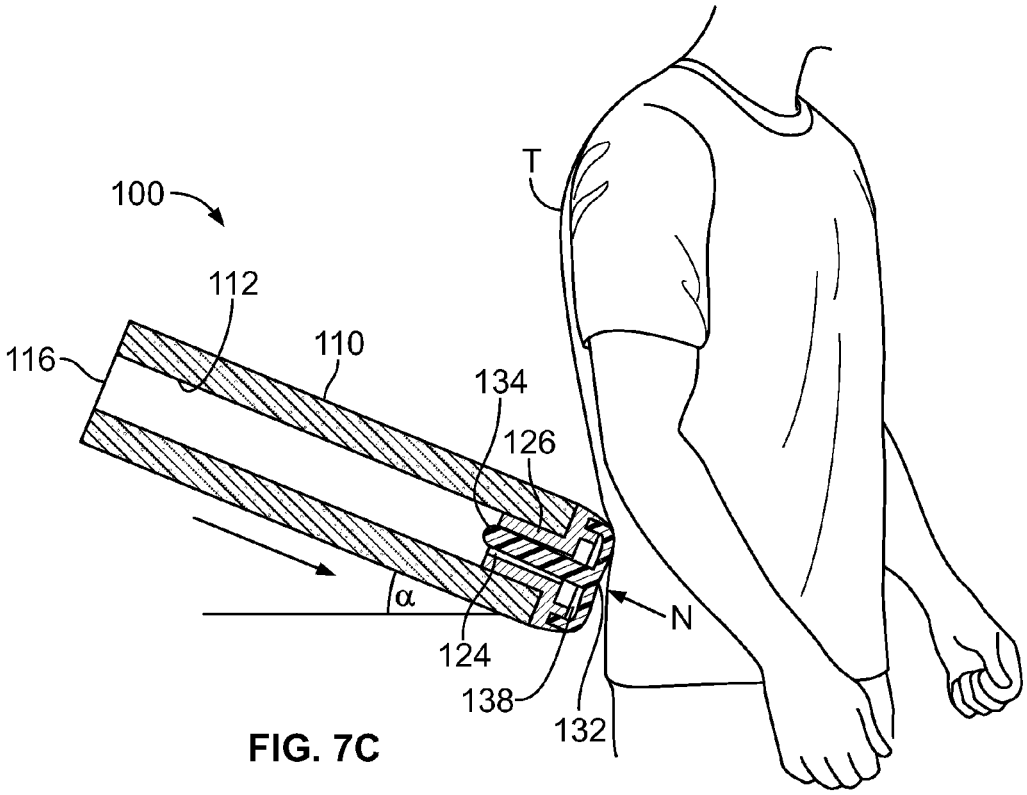
FIG. 7C is a side, cross-sectional view of the dart of FIG. 1 deforming upon impacting the target at an oblique angle.
Figure 8A:
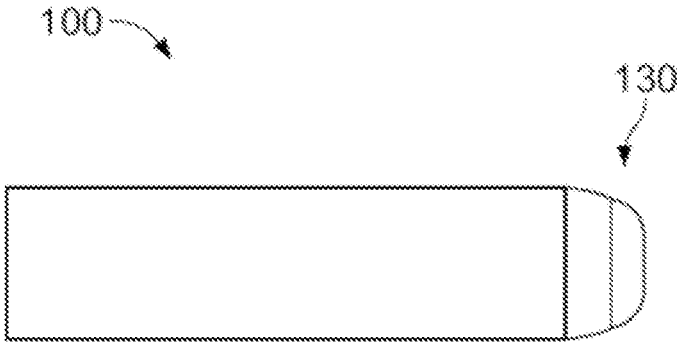
FIG. 8A is a side view of the dart of FIG. 1.
Figure 8B:
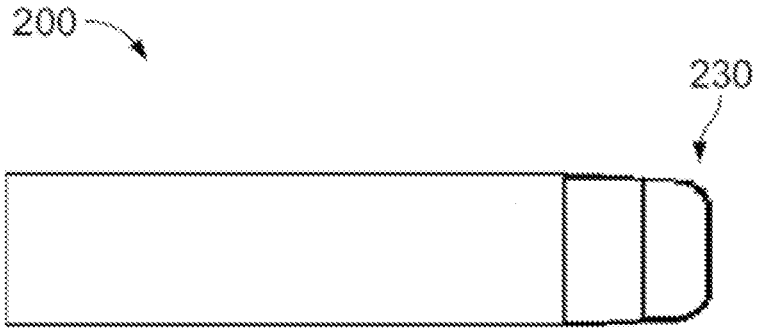
FIG. 8B is a side view of a dart according to an exemplary embodiment of the present disclosure.
Figure 8C:
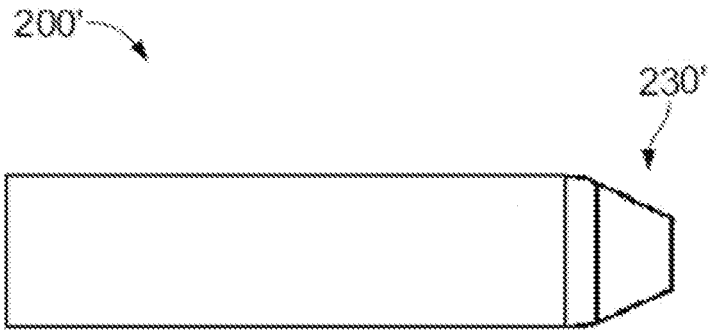
FIG. 8C is a side view of a dart according to an exemplary embodiment of the present disclosure.
Figure 8D:
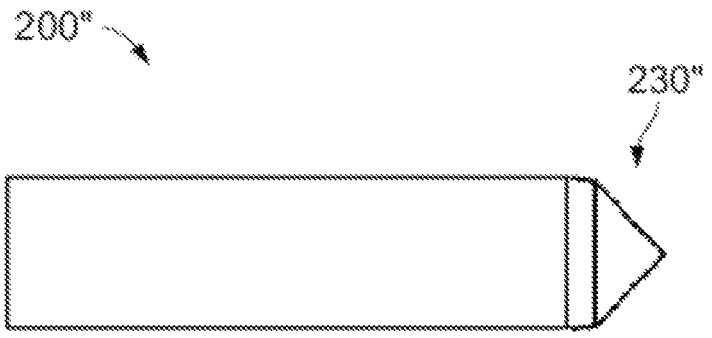
FIG. 8D is a side view of a dart according to an exemplary embodiment of the present disclosure.
Figure 8E:
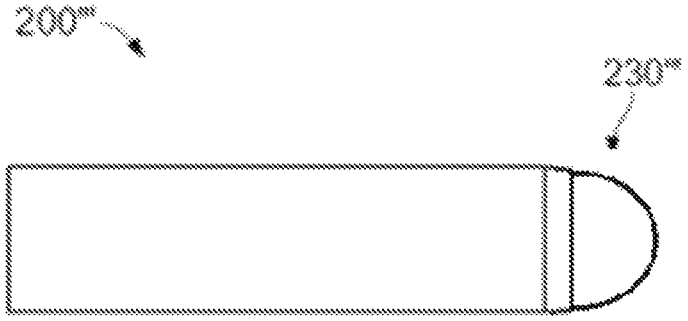
FIG. 8E is a side view of a dart according to an exemplary embodiment of the present disclosure.

Turning to FIGS. 7A, 7B, and 7C, in an exemplary embodiment, post 134 may also control aspects of the impact between dart 100 during impact with a target T at an oblique angle, e.g., an impact other than a head-on impact. As shown, dart 100 may impact target T at an oblique angle α. Accordingly, the target T may generate a normal force N against the head portion 132 at an angle α. The normal force N may cause the cap 130 to be tilted or shifted with respect to the base 120 and/or body 110 such that a portion of the post 134 of cap 130 forcibly contacts the interior surface of the mount bore 124 of base 120, and/or the interior surface of body bore 112 of body 110. Such contact between the post 134 and body bore 112 and/or mount bore 124 may cause the dart body 110 and/or base 120 to absorb energy from the impact of dart 100 with target T. In embodiments, the body 110 and/or base 120 may absorb energy from the impact of dart 110 with target T via, e.g., friction, sound, and/or mechanical vibration. The absorption of energy by dart body 110 and/or base 120 may more evenly distribute the normal force N such that the profile and/or trajectory of dart 100 is substantially unaltered. In this manner, the body 110 of dart 100 may act as a dampening member, with the post 134 of cap 130 acting as a force-distributing member.

While this invention has been described in conjunction with the embodiments outlined above, it is evident that many alternatives, modifications and variations will be apparent to those skilled in the art. Accordingly, the exemplary embodiments of the invention, as set forth above, are intended to be illustrative, not limiting. Various changes may be made without departing from the spirit and scope of the invention.

What is claimed is:

1. A dart, comprising:

an elongate dart body having a first end, a second end, and an interior bore;

a base including a mount and a stem inserted into the interior bore of the dart body at the first end of the dart; and a cap attached to the base and having a flexible substantially bulbous-shaped head portion and an interior post so that the head portion is configured to deform upon an impact.

2. The dart of claim 1, wherein the dart body is comprised of foam.

3. The dart of claim 1, wherein the dart body has a circular cross-section.

4. The dart of claim 1, wherein the dart body has a cylindrical configuration.

5. The dart of claim 1, wherein a chamber is disposed between the head portion and the base.

6. The dart of claim 5, wherein the head portion is configured to at least partially collapse into the chamber upon an impact.

7. The dart of claim 1, wherein, the cap is configured such that the post forcibly contacts a portion of the base upon an impact.

8. The dart of claim 7, wherein the base is configured to absorb energy from the post upon an impact.

9. The dart of claim 1, wherein the post forcibly contacts a portion of the dart body upon an impact.

10. The dart of claim 9, wherein the dart body is configured to absorb energy from the post upon an impact.

11. The dart of claim 1, wherein the interior bore of the body in combination with the chamber form an interior fluid path.

12. The dart of claim 11, wherein the cap is configured such that the cap is deformed and fluid is forced through the fluid path to exit the interior bore of the body upon an impact.

13. The dart of claim 11, wherein the interior fluid path further comprises an aperture formed on an outer surface of the dart ahead of the second end of the dart body so that the aperture can generate an audible sound as fluids are moved therealong when the dart is in flight.

14. The dart of claim 1, wherein the cap comprises a resilient material so that, upon impact, the cap may be deformed but be capable of returning to its pre-impact shape.

15. The dart of claim 1, wherein the head portion of the cap is affixed to the base along a groove disposed along an upper surface of the base.

16. The dart of claim 1, wherein the cap has a length of between about 8 mm and 27 mm, the cap has a diameter of less than about 11 mm at its widest point, the base has a length of about 8 mm to about 12 mm, and the base has a diameter at its widest point of between about 9 mm and about 13 mm.

17. The dart of claim 1, wherein the cap has a suction member attached to it.

18. The dart of claim 1, wherein the head portion of the cap has a Shore A durometer of about 55.

19. The dart of claim 1, wherein the head portion of the cap is about 0.5 mm thick.

20. The dart of claim 1, wherein a center of gravity of the dart is disposed near the first end of the dart body.

* * * * *